United States Patent [19]

Kohler

[11] 4,201,491

[45] May 6, 1980

[54] LIQUID APPLICATOR

[75] Inventor: Henry A. Kohler, Orchard Park, N.Y.

[73] Assignee: Truly Magic Products, Inc., Buffalo, N.Y.

[21] Appl. No.: 916,812

[22] Filed: Jun. 19, 1978

[51] Int. Cl.[2] ..... B43M 11/06; B05C 1/00

[52] U.S. Cl. ..... 401/264; 401/145; 401/148; 401/184; 222/490

[58] Field of Search ..... 401/145, 148, 152, 156, 401/183, 184, 202, 269, 272–275, 278–280, 289; 222/490

[56] References Cited

U.S. PATENT DOCUMENTS

| | | | |
|---|---|---|---|
| 2,281,367 | 4/1942 | Moll | 401/272 |
| 2,334,032 | 11/1943 | Rhodes | 222/490 |
| 2,446,085 | 7/1948 | Gronemeyer | 222/490 |
| 2,665,037 | 1/1954 | Zublin | 222/490 |
| 3,148,401 | 9/1964 | Gilchrist | 401/156 |
| 3,172,356 | 3/1965 | Vosburg | 401/148 |
| 3,319,837 | 5/1967 | Mueller | 401/145 |
| 3,384,438 | 5/1968 | Sherbondy | 222/490 |
| 3,418,055 | 12/1968 | Schwartzman | 401/206 |

FOREIGN PATENT DOCUMENTS

| | | | |
|---|---|---|---|
| 1025878 | 1/1953 | France | 401/273 |

*Primary Examiner*—Clyde I. Coughenour
*Attorney, Agent, or Firm*—Joseph P. Gastel

[57] ABSTRACT

An applicator for liquid from a container including a flexible resilient inlet portion for placement in communication with the container, a control membrane extending across the inlet portion, a slit in the control membrane, a rib in the inlet portion for bearing on the control membrane when the inlet portion flexes to thereby open the slit and for preventing the inlet portion from obstructing the slit in the control membrane during flexing of the inlet portion, a frame on the opposite side of the control membrane from the inlet portion, fabric mounted on said frame, and a plurality of lugs on the control membrane for maintaining the fabric a relatively fixed distance therefrom to thereby maintain the size of the chamber defined by the control membrane and the fabric substantially constant.

5 Claims, 6 Drawing Figures

LIQUID APPLICATOR

BACKGROUND OF THE INVENTION

The present invention relates to an improved liquid applicator of the type which is mounted on shoe polish dispensing bottles or the like for the purpose of dispensing liquid onto a surface.

By way of background, there are numerous applicators known for the purpose of dispensing liquid. One such applicator is disclosed in U.S. Pat. No. 3,148,401. However, in this applicator there is the tendency for the liquid inlet portion to at least partially obstruct the slit in the control membrane during liquid application. Furthermore, the volume of the chamber below the control membrane tends to change in size. In addition, there is no structure for positively opening the slit in the control membrane during liquid dispensing. All of the foregoing factors tend to cause an uneven flow of liquid onto a surface. Other applicators of the prior art also possessed at least one of the foregoing deficiencies. In addition, in certain prior art applicators the liquid-spreading fabric was cemented directly to the control diaphragm, and when this was distorted during liquid application, there was a disruption of full-face contact between the fabric and the surface onto which liquid was being deposited. It is with overcoming the foregoing deficiencies of prior art applicators that the present invention is concerned.

SUMMARY OF THE INVENTION

It is one object of the present invention to provide an improved liquid applicator for mounting on a container, the applicator being capable of providing a relatively even flow of liquid to a surface.

It is another object of the present invention to provide an improved liquid applicator wherein the rate of flow of liquid can be controlled by how hard the applicator is pressed against a surface.

Another object of the present invention is to provide an improved liquid applicator which includes structure for positively opening a slit in a control membrane, thereby assuring liquid flow.

It is a further object of the present invention to provide an improved applicator which maintains a substantially full face contact between the applicator and the surface which is being treated during all conditions of operation, thereby tending to insure uniformity of liquid application. Other objects and attendant advantages of the present invention will readily be perceived hereafter.

The present invention relates to an applicator for applying liquid form a container comprising a flexible resilient inlet portion for placement in communication with said container to receive liquid therefrom, a control membrane extending across said inlet portion, a normally closed slit in said control membrane deformable to a more open position upon flexing of said control membrane, means on the opposite side of said control membrane from said inlet portion for depositing liquid on a surface, and means on said inlet portion for bearing against said control membrane upon flexing of said inlet portion to thereby positively open said slit. In accordance with another aspect of the present invention, the means for depositing liquid on the surface comprises a frame on said body portion, porous fabric attached to the frame in spaced relationship to the control membrane to define a chamber with said control membrane, and means on the control membrane for maintaining the porous fabric in spaced relationship to the control membrane to thereby maintain the chamber of substantially constant size to effect substantially constant liquid flow, and to also maintain the fabric in full-face engagement with the surface onto which liquid is being applied. The various aspects of the present invention will be more fully understood when the following portions of the specification are read in conjunction with the accompanying drawings wherein:

DESCRIPTION OF THE PREFERRED EMBODIMENTS

Figure 1:
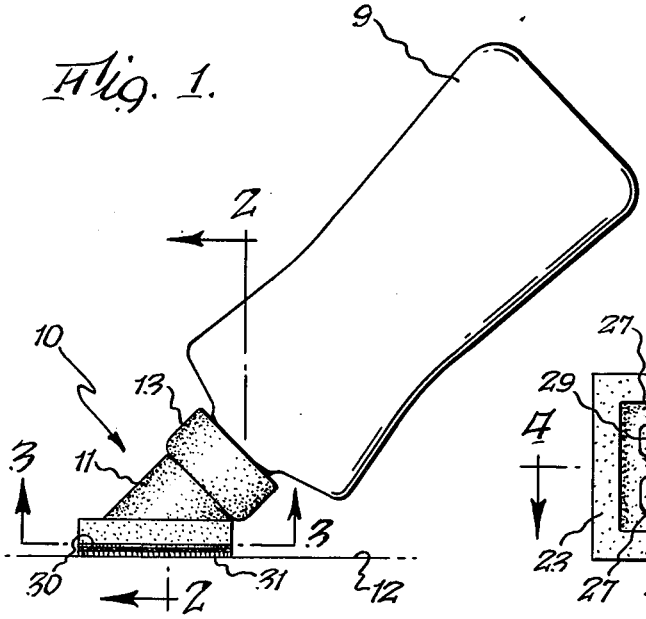
FIG. 1 is a fragmentary side elevational view of a liquid container mounting the improved liquid applicator of the present invention.
Figure 3:
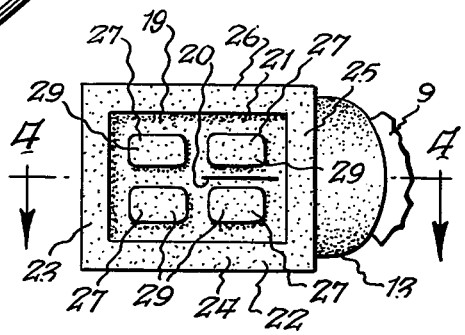
FIG. 3 is a fragmentary view taken in the direction of arrows 3—3 of FIG. 1 and showing the bottom portion of the improved applicator.

The improved applicator 10 of the present invention is shown mounted on a bottle or flexible plastic container 9 which may contain shoe polish or any other liquid which is to be applied in a thin layer onto surface 12. Applicator 10 is fabricated from flexible resilient rubber which has been molded in the configuration shown in FIGS. 1, 2, 3 and 4. A neck 13 is of an annular configuration with groove 14 molded therein to receive bead 15 at the end of neck 16 of bottle 9. A tubular liquid inlet portion 11 is formed on applicator 10 and is in communication with bottle 9 to receive the contents thereof. A control membrane 19 is formed integrally with inlet portion 11 to provide a chamber 17, and a slit 20 is formed in control membrane 19.

When applicator 10 is in its unstressed condition shown in FIGS. 1, 2, 3 and 4, slit 20 is biased to a closed position by the normal resiliency of the applicator, to thereby prevent liquid from passing beyond inlet chamber 17 to the outside of the applicator. However, when inlet portion 11 is distorted (FIG. 5), as would be the case when a downward force is applied to bottle 9 during the applying of liquid to a surface, slit 20 is caused to open sufficiently to permit the liquid to pass through control membrane 19 into chamber 21 on the opposite side of membrane 19 from inlet portion 11. Chamber 21 is defined by membrane 19 and the frame 22 consisting of the side wall portions 23, 24, 25 and 26 molded integrally with membrane 19, and the fabric 30 secured to frame 22.

Figure 2:
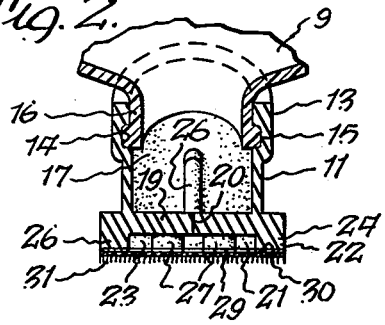
FIG. 2 is a fragmentary cross sectional view taken substantially along line 2—2 of FIG. 1 and showing a portion of the liquid applicator including the rib which bears against the control membrane upon flexing of the liquid inlet portion to positively open the slit and for preventing the inlet portion from moving into obstructing relationship with the slit of the control membrane.
Figure 6:
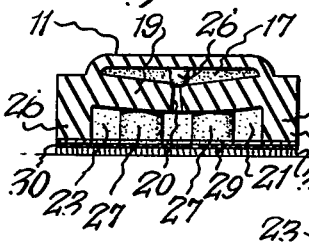
FIG. 6 is a cross sectional view taken substantially along line 6—6 of FIG. 5 and showing how the rib deflects the control membrane to open the slit.
Figure 5:
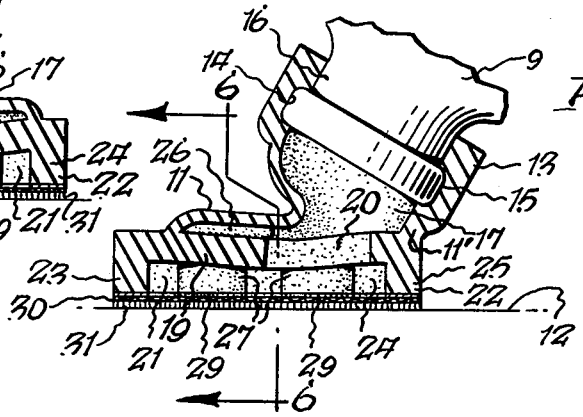
FIG. 5 is a fragmentary cross sectional view similar to FIG. 4 but showing the position the applicator takes when a downward force is applied to the liquid bottle which results in flexing of the inlet portion of the applicator.

It is to be especially noted from FIGS. 2, 5 and 6 that an elongated rib 26 is molded integrally with inlet portion 17 so that when inlet portion 11 is distorted incidental to applying liquid, rib 26 bears against control membrane 19 to cause slit 20 to open. Rib 26 also prevents inlet portion 11 from flexing into obstructing relationship relative to slit 20. It will be appreciated that rib 26 may be shaped differently than shown. The reason that rib 26 moves into engagement with control membrane 19 is because the inlet portion 11 at 11' is extremely short compared to the remainder of the inlet portion so that when a downward force is applied to bottle 9, cylindrical inlet portion 11 will be distorted as shown in FIG. 5. It will also be appreciated that the amount that slit 20 is opened depends directly on the amount of downward force applied to applicator 10, so that such force determines the rate of flow.

Figure 4:
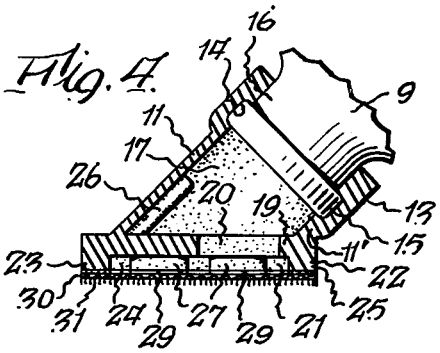
FIG. 4 is a fragmentary cross sectional view taken substantially alone line 4—4 of FIG. 3 and showing the applicator in its normal unstressed condition.

A plurality of bosses or lugs 27 are molded integrally with control membrane 19, and their outer surfaces 29 lie substantially in the same plane as the outer surface of frame 22 (FIGS. 2, 4 and 5). Bosses 27 aid in maintaining the integrity of chamber 21 in that they cause this chamber to essentially maintain a predetermined constant volume regardless of the shape to which it is distorted during operation, thereby assuring a relatively constant flow of liquid onto surface 12 because of the fact that chamber 21 contains substantially the same volume of liquid at all times.

Velour cloth or fabric 30 is cemented by means of a suitable adhesive to the surface of frame 22 and to surfaces 29 of bosses 27. If desired, fabric 30 need not be cemented to surfaces 29, so that there can be relative motion therebetween during flexing of the frame 22. Whether or not fabric 30 is cemented to surface 29, the fabric 30 is supported at a plurality of locations, namely, on the surface of the frame and on the surfaces 29 of lugs 27, so that the fabric is pressed into good engagement with the surface onto which liquid is being applied. In other words, the fabric 30 cannot bow away from the surface 12. When this feature is considered in combination with the feature of maintaining the volume of liquid in chamber 21 substantially constant, an even application of liquid to surface 12 is assured.

Fabric 30 is sufficiently porous to permit passage of liquid and pigments contained therein. Fabric 30 also has an upstanding nap 31 which distributes the liquid onto surface 12. The advantage of using fabric is that it does not degrade as a result of exposure to moisture. Furthermore, cloth 30 with dried liquid thereon will not rip when it is stressed during the initial part of liquid application. It will be appreciated, however, that materials other than fabric can be used, for example, porous foam material.

While the applicator 10 has been described as being fabricated from rubber, it will be appreciated that it also can be fabricated from other flexible resilient materials, such as vinyl.

While preferred embodiments of the present invention have been disclosed, it will be appreciated that the present invention is not limited thereto but may be otherwise embodied within the scope of the following claims.

What is claimed is:

1. An applicator for liquid from a container comprising a flexible resilient tubular inlet portion including an annular wall, an end on said tubular inlet portion, means on said end for mounting relative to said container for causing said inlet portion to receive liquid from said container, a control membrane spaced from said end and extending across said tubular inlet portion to define a chamber therewith, a normally closed slit in said control membrane deformable to a more open position upon flexing of said control membrane, means on the opposite side of said control membrane from said inlet portion for depositing liquid on a surface, and rib means integral with said annular wall and projecting from the internal surface thereof and extending along said annular wall for bearing against said control membrane upon distortion of said inlet portion to thereby deform said control membrane to open said slit, said rib means being so oriented relative to said control membrane when in engagement therewith to effect said deformation of said control membrane to open said slit without effectively blocking said slit.

2. An applicator as set forth in claim 1 wherein said rib means includes a portion located substantially at the intersection of said annular wall and said control membrane.

3. An applicator as set forth in claim 1 wherein said annular wall includes a short side and a long side, and wherein said rib means comprises an elongated rib molded integrally with said long side.

4. An applicator as set forth in claim 1 wherein said rib means is so oriented relative to said slit so as to prevent said annular wall from obstructing said slit when said rib means bears against said control membrane.

5. An applicator as set forth in claim 1 wherein said means for depositing liquid on said surface comprises a frame molded integrally with said inlet portion, porous material attached to said frame to define a second chamber with said control membrane, a plurality of bosses molded integrally with said control membrane on the side thereof opposite to said inlet portion for maintaining said porous material in uniform spaced relationship to said control membrane under all conditions of use, whereby said second chamber will maintain a substantially constant volume under all conditions of use regardless of the amount of distortion of said membrane or said porous material, said bosses being spaced from each other and from said frame to thereby permit said second chamber to encircle said bosses, said slit being closed to prevent liquid flow from said chamber to said second chamber when said control membrane is in its normal undistorted condition.

* * * * *